US007507107B2

(12) United States Patent
Tuerschmann et al.

(10) Patent No.: US 7,507,107 B2
(45) Date of Patent: Mar. 24, 2009

(54) CONNECTOR ARRANGEMENT, AND METHOD FOR MOUNTING THE SAME

(75) Inventors: Dieter Tuerschmann, Weiterstadt (DE); Torsten Feige, Bielefeld (DE); Joerg Scheer, Huellhorst (DE); Peter Stuckmann, Lage (DE)

(73) Assignee: Weidmuller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 12/215,565

(22) Filed: Jun. 28, 2008

(65) Prior Publication Data

US 2008/0286996 A1 Nov. 20, 2008

(30) Foreign Application Priority Data

Jul. 4, 2007 (DE) ..... 10 2007 031 194

(51) Int. Cl.
*H01R 11/20* (2006.01)

(52) U.S. Cl. ..... 439/441

(58) Field of Classification Search ..... 439/152, 439/409, 391, 410, 432, 441
See application file for complete search history.

(56) References Cited

U.S. PATENT DOCUMENTS 5,816,843 A * 10/1998 Gerberding ..... 439/410
6,319,046 B1 * 11/2001 Feye-Hohmann et al. ... 439/395
6,527,580 B1 * 3/2003 Suss et al. ..... 439/417
6,712,641 B2 * 3/2004 Beege et al. ..... 439/441
6,796,855 B2 9/2004 Fricke
6,848,945 B1 * 2/2005 Lecuppe et al. ..... 439/620.01
6,860,752 B2 * 3/2005 McCoy et al. ..... 439/441

FOREIGN PATENT DOCUMENTS

DE 196 14 977 A1 10/1996
EP 1 253 670 B1 4/2006

OTHER PUBLICATIONS

"Contract Electronic Manufacturing," by Micron Corporation, website Jun. 26, 2008.
"The Hermetic Surface Mount Device (SMD), Its Advantages and Solutions to Assembly Integration," by Tiva Bussarakons, International Rectifier, Inc., website, Jun. 26, 2008.

* cited by examiner

*Primary Examiner*—Neil Abrams
*Assistant Examiner*—Phuong Nguyen
(74) *Attorney, Agent, or Firm*—Lawrence E. Laubscher, Sr.; Lawrence E. Laubscher, Jr.

(57) ABSTRACT

An improved electrical connector is formed by stamping and bending a sheet of conductive metal, wherein as a preliminary step, a series of longitudinally-spaced openings are formed in the sheet to define a plurality of transversely extending strips from the side edges of which a pair of parallel spaced integral side walls extend, which sheet is coiled on a storage spool, and is subsequently unwound and fed toward a stamping station at which the transverse strips are severed at spaced separation points, thereby to define a connector body wall integral with the side walls. The side walls have portions that are simultaneously bent to form top, bottom and/or end walls which cooperate to define a chamber in which a spring contact is mounted. The connector is then connected an electrical component, such as a printed circuit board, in the manner of a surface mounted device (SMD).

9 Claims, 9 Drawing Sheets

Fig. 1d
Fig. 1c
Fig. 1b
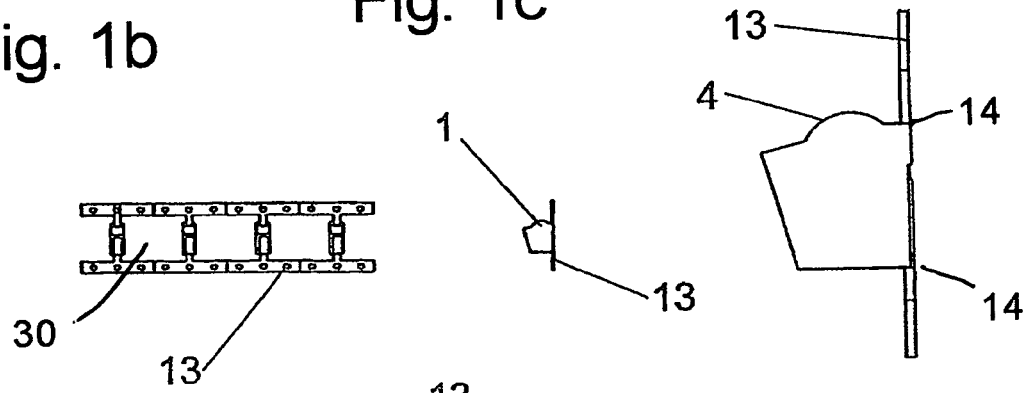
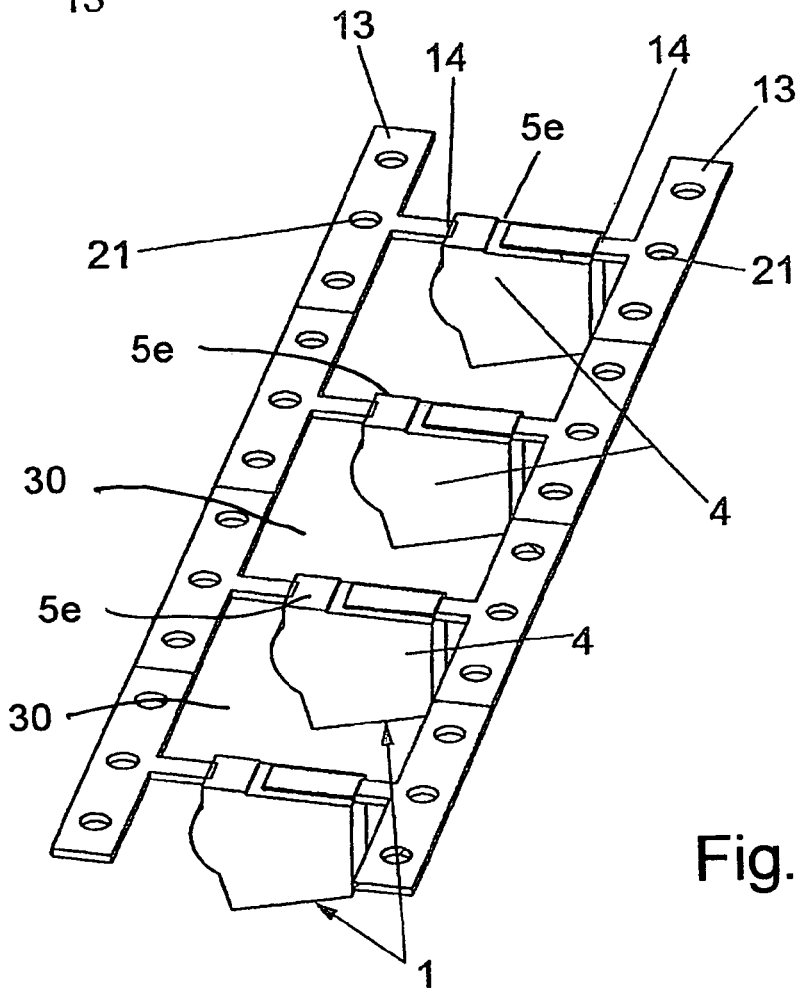
Fig. 1a

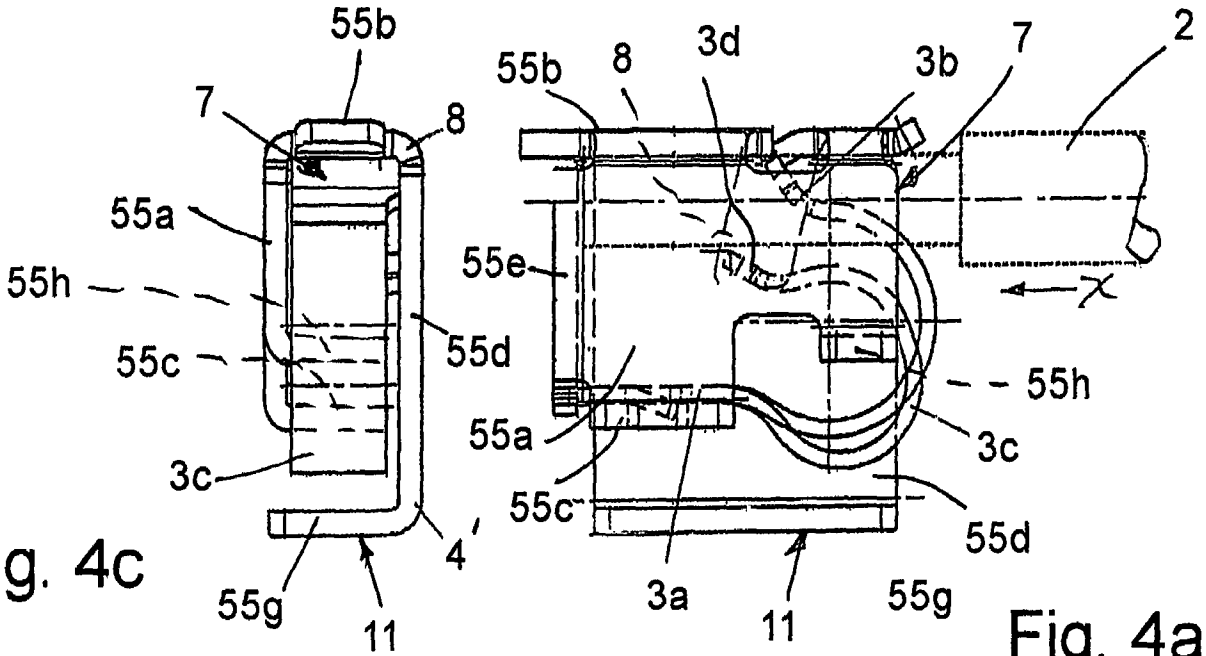
Fig. 4a
Fig. 4c
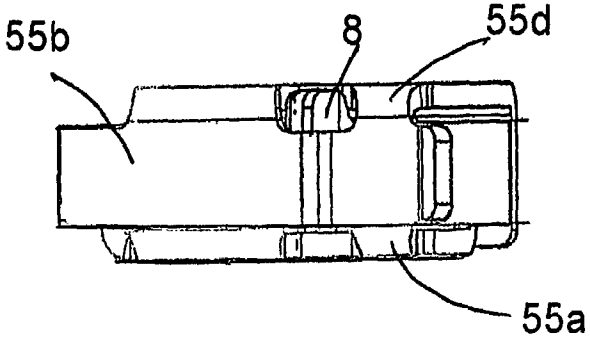
Fig. 4b 55b
8
55d
4'
3a
11
55a 9
y
3a
4'
55d
2
3
55g
11
x 55d
8
3a
4'
55c
11
55b
55g
3c
2

3a
55c
8
55b
3d
55a
3c
55g
55d
11

CONNECTOR ARRANGEMENT, AND METHOD FOR MOUNTING THE SAME

BACKGROUND OF THE INVENTION

1. Field of the Invention

An improved electrical connector is formed by stamping and bending a sheet of conductive metal, wherein as a preliminary step, a series of longitudinally-spaced openings are formed in the sheet to define a plurality of transversely extending strips from the side edges of which a pair of parallel spaced integral side walls extend, which sheet is coiled on a storage spool, and is subsequently unwound and fed toward a stamping station at which the transverse strips are severed at spaced separation points, thereby to define a connector body wall integral with the side walls. The side walls have portions that are simultaneously bent to form top, bottom and/or end walls which cooperate to define a chamber in which a spring contact is mounted.

2. Description of Related Art

It is known in the electrical connector art to provide a connection device made as a spring terminal for the connection of conductors, as well as a method for the assembly of connection devices that can be made as a spring terminal or also in some other way for connection to electrical conductors, such as an IDC connection or as a screw connection.

Spring terminals for connection of a conductor that have a terminal body with an open front for the introduction of the conductor and a spring contact arranged in the terminal body for contacting the conductor and for firmly clamping the conductor in the terminal body are known, for example, from the European patent No. EP 1 253 670 A2.

Another spring terminal is known from the German patent No. DE 196 14 977. An attachment leg—a kind of bracket—is used as overextension protection of the spring and simultaneously as actuation lever and is made integrally with the spring. The spring terminal is actuated, for example, with a screwdriver, with which the spring, for example, is opened out of the introduction direction of the conductor.

It is, moreover, known that spring terminals can be so designed that a conductor can be inserted into the terminal body into the contact point between the spring and a bus bar directly against the spring force without any need for separately opening the spring. This technique, also referred to as a "push-in connector" is described, for example, in the U.S. patent to Fricke et al U.S. Pat. No. 6,797,855 B2. The conductor can be separated out of the contact point with the aid of a screwdriver.

Against this background, it is the object of the invention, on the one hand, to create a spring terminal that is made as a spring terminal by way of the direct plug-in technique, which has a particularly compact structure. Moreover, there is to be created a particularly simple, automatable process for the assembly of such connection devices, preferably also those with other structures.

According to the present invention, the connector body has at least one lateral opening through which an insulated conductor can be separated laterally or essentially laterally (out of an angle between approximately 60 and 90°) with respect to the conductor insertion direction out of the contact point between the spring contact and the terminal body. According to another invention, the terminal body furthermore has surfaces that are suitable for a surface mounted device (SMD) assembly on a structural part, in particular, a printed circuit board.

Because of the use of only a few parts, the spring terminal has a relatively simple and inexpensive design. It is furthermore easily assembled and can be made relatively small.

The invention also creates a method for assembly of connection devices, whereby the assembly of an arrangement takes place by unrolling the assembly line from a spool, and separating a wall from the metal material between a pair of separation points on the material.

SUMMARY OF THE INVENTION

Accordingly, a primary object of the invention is to provide a connector including a rectangular body formed by stamping and bending from a metal sheet, including a given top wall or end wall that is integral with and orthogonally arranged relative to a pair of parallel spaced side walls. As the given wall is separated from a support strip defined in a sheet of metal material, portions of the integral side walls are bent to form top, bottom or end walls that define a chamber containing the resilient spring contact.

According to another object of the invention, following the preliminary step of punching out the strip and parallel space side wall portions of the metal sheet, the sheet is coiled on a storage spool, and is subsequently fed to a stamping station at which the connector body wall that is integral with the side walls is separated from the strip, and portions of the side walls are bent to define the chamber that contains the spring contact.

BRIEF DESCRIPTION OF THE DRAWINGS

Other objects and advantages of the invention will become apparent from a study of the following specification, when viewed in the light of the accompanying drawing, in which:

FIG. 1*a* is a perspective view of the assembly line for producing the connector arrangement of the present invention;

FIGS. 1*b* and 1*c* are schematic top plan and sectional representations of the sheet metal strip of FIG. 1*a*, and FIG. 1*d* is an enlarged view of the product of FIG. 1*c;*

FIGS. 4*a*-4*c* are left side, top, and right end views of a second embodiment of the invention;

DETAILED DESCRIPTION OF THE INVENTION

Figure 2A:
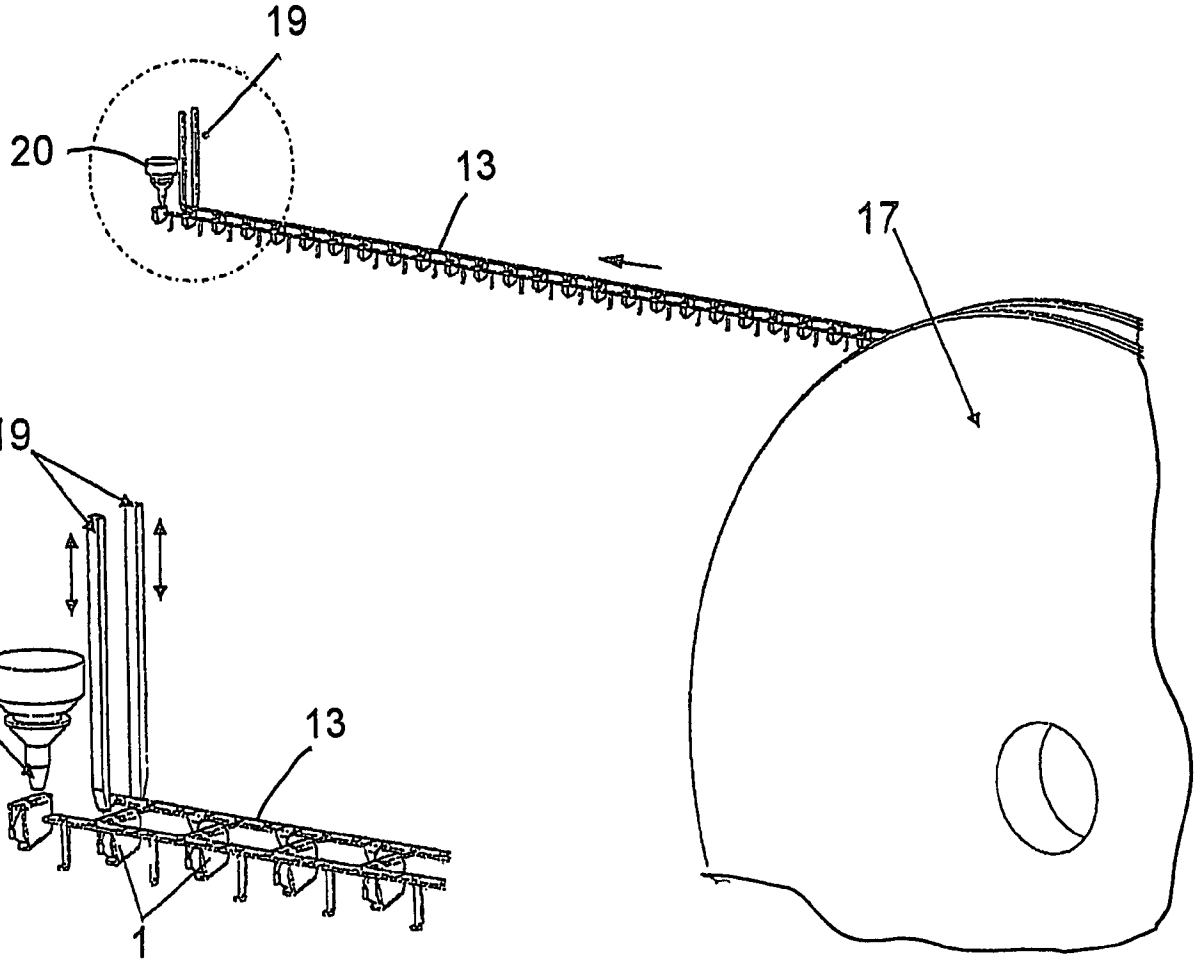
FIGS. 2*a*-2*b* is a diagrammatic perspective view illustrating the manner of transport of the sheet material to a stamping and suction transfer station.

Referring first to FIGS. 1*a*-1*d* and 3*d*, an assembly 13 of conductive sheet metal material is preliminarily stamped to provide a plurality of longitudinally-spaced openings 30 that define a series of transversely extending strips each containing a pair of spaced separation points 14 between which are defined an end wall portion 5*e* of a connector body 4, which end wall portion is integral with a pair of orthogonally arranged side wall 5*a* and 5*d*. This sheet material is then coiled on the storage spool 17 (FIG. 2*a*) for subsequent feeding to a stamping station 19 at which the end wall 5*e*, together with the integral side walls 5*a* and 5*d* carried thereby, is separated and transported by the suction pipette to a further processing station. Top wall 5*b* and bottom wall 5*c* are bent orthogonally relative to the side wall 5*a*, and end wall 5*f* is bent orthogonally relative to the other side wall 5*d*, thereby to define a chamber in which is mounted a generally U-shaped contract spring 3. The contact spring includes a pair of leg portions joined by an intermediate portion, the first leg portion being fastened to the bottom wall 5*c*, and the second leg portion 3 being biased toward the top wall 5*b*.

Figure 9:
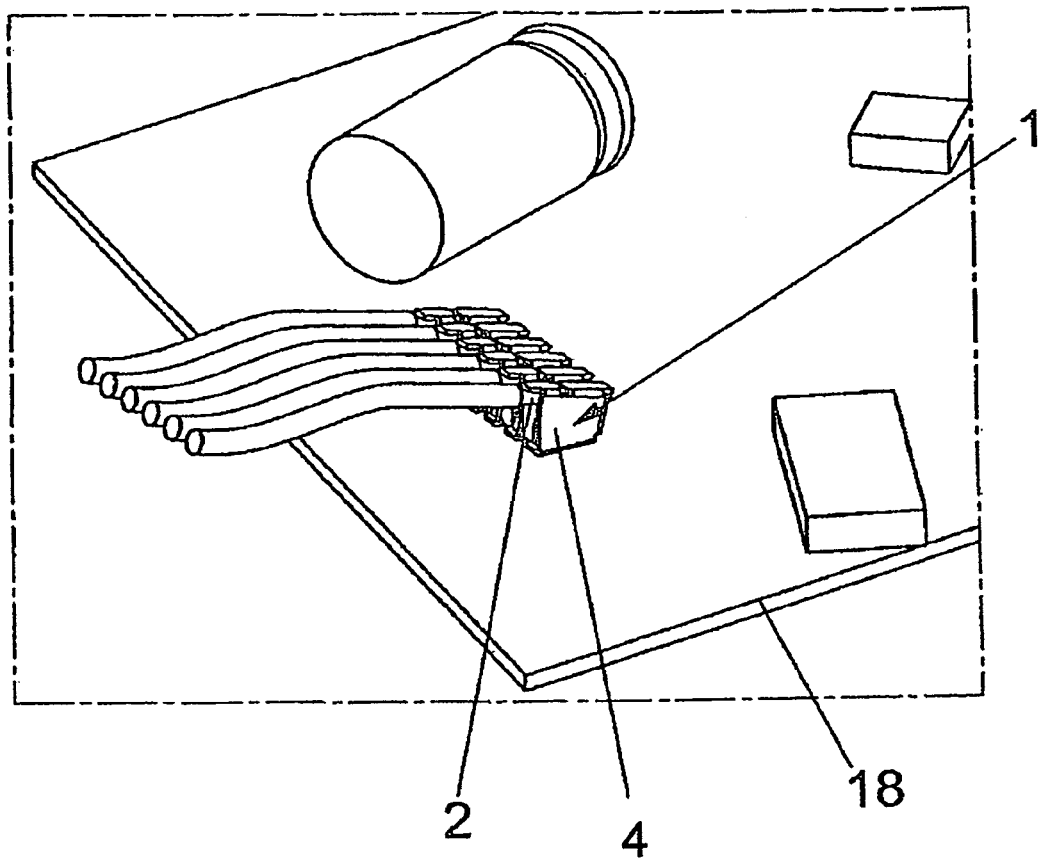
FIG. 9 is a detailed perspective view of a bank of the connectors secured to a printed circuit board.

Consequently, upon the introduction of the bare end portion of an insulated conductor 2 into the connector chamber via the opening 7 defined in the end wall 5*f*, the conductor abuts the stop 6 defined by the end wall 5*e*, whereupon the bare conductor end is gripped by the free end 3*d* of the second leg of the spring contact and is biased toward the connector body top wall 5*b*. Thus, the connector is of the direct plug-in type with the metal connector body 4 functioning as a conducting bus bar. Because no bus bar is needed, the spring terminal can be made in the form of the smallest possible model for the connection of very thin conductors. It is especially suitable as a small connection terminal for printed circuit boards 18 (FIG. 9), where, as a rule, these terminals are assembled next to each other in a relatively insulated manner.

Terminal body 4, looking at a cross-section from the size (FIG. 3*d*), has a trapezoidal shape with four side walls 5*a*-5*d*, which are bent together from a basic blank that is punched or cut out of a piece of sheet metal. The bottom surface 10 of the bottom wall 5*c* defines a contact surface, as will be described in greater detail below.

FIGS. 4 and 5 show an alternate design with a rectangular terminal body. In this embodiment, the top wall 55*b* is integral with the side walls 55*a* and 55*d*. Bent inwardly form the lowermost edge of the side wall 55*a* is the bottom wall 55*c* to which is fastened the leg 3*a* of the spring contact 3. Also bent inwardly from this wall 55*a* is the transverse support member 55*h*. Bent inwardly from the lower edge of the other side wall 55*d* beneath and parallel with the bottom wall 55*c* is a second bottom wall 55*g* having a bottom contact surface 11. The connector body is closed here by means of one or several laser weld points 16.

It is important to note that the corner between the side wall 5*a* and the top wall 5*b* contains an access opening 8 opposite the upper spring leg, thereby to permit opening of the contact point with the tip of a screwdriver 9.

Figures 5A, 5B, 5C, 5D:
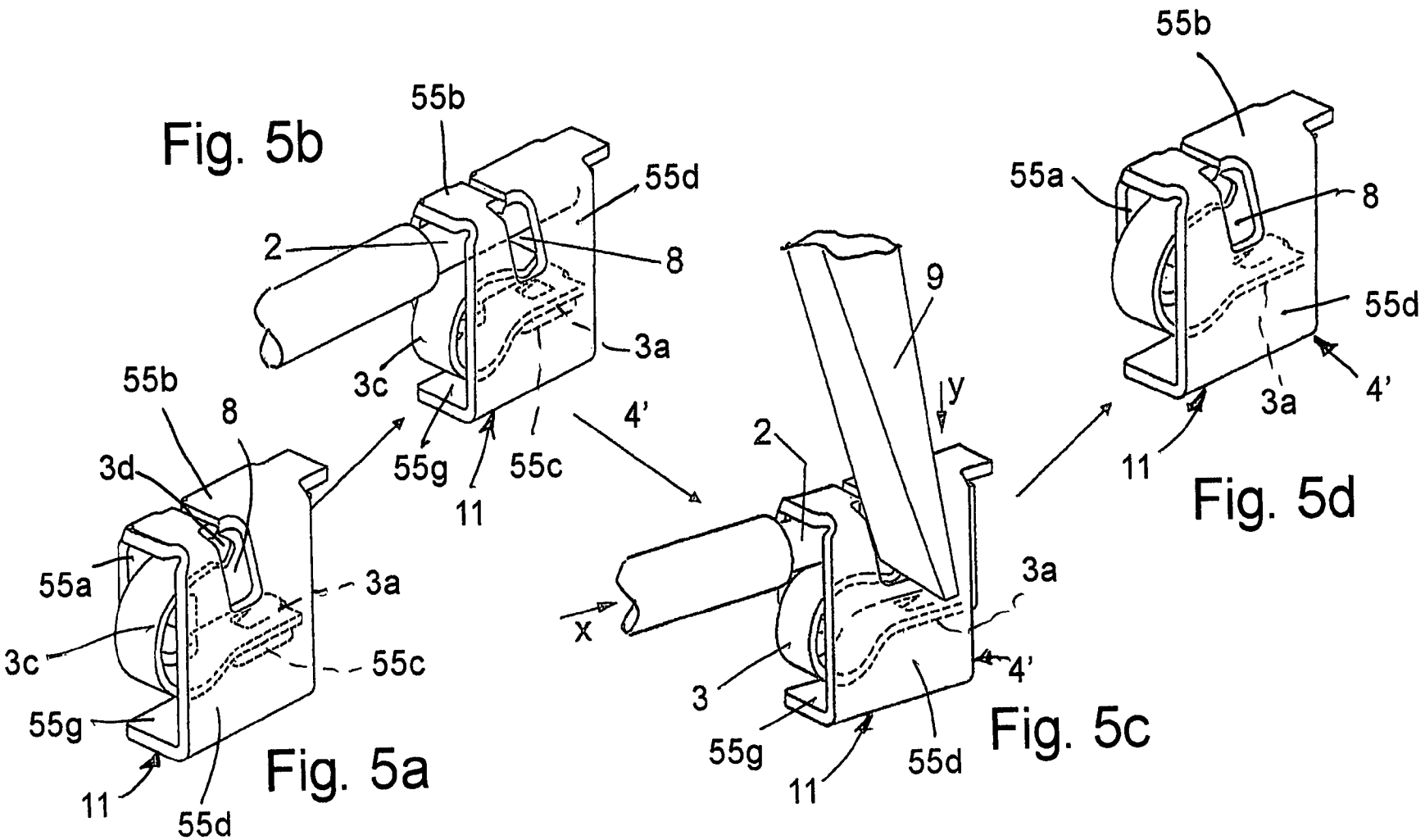
FIGS. 5*a*-5*d* are perspective views illustrating the manner of connecting and disconnecting an insulated conductor relative to the second connector embodiment.
Figure 6:
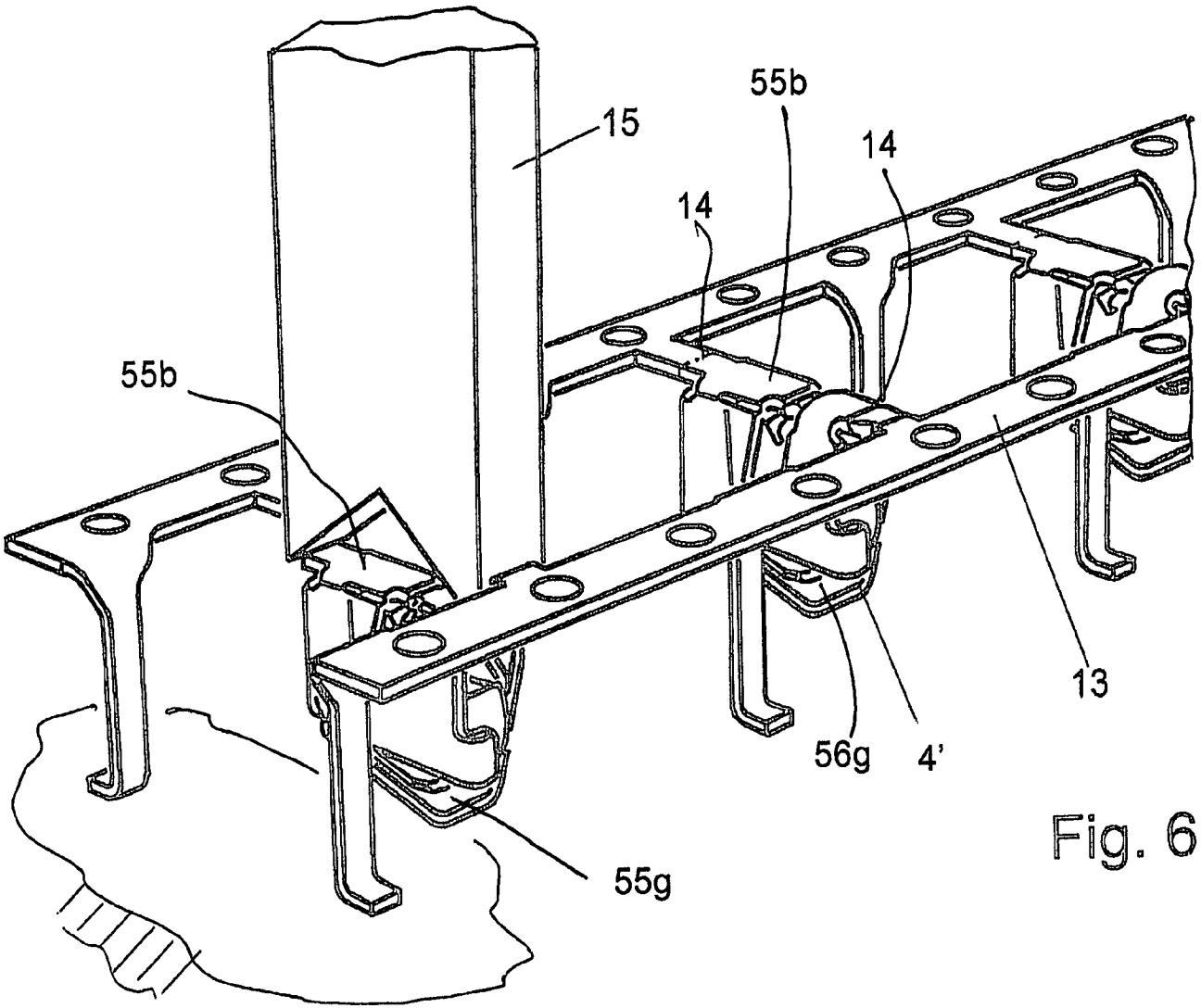
FIGS. 6 and 7 are perspective views illustrating the manner in which the sheet material is stamped and bent to separate the connector body from the material.
Figure 7:
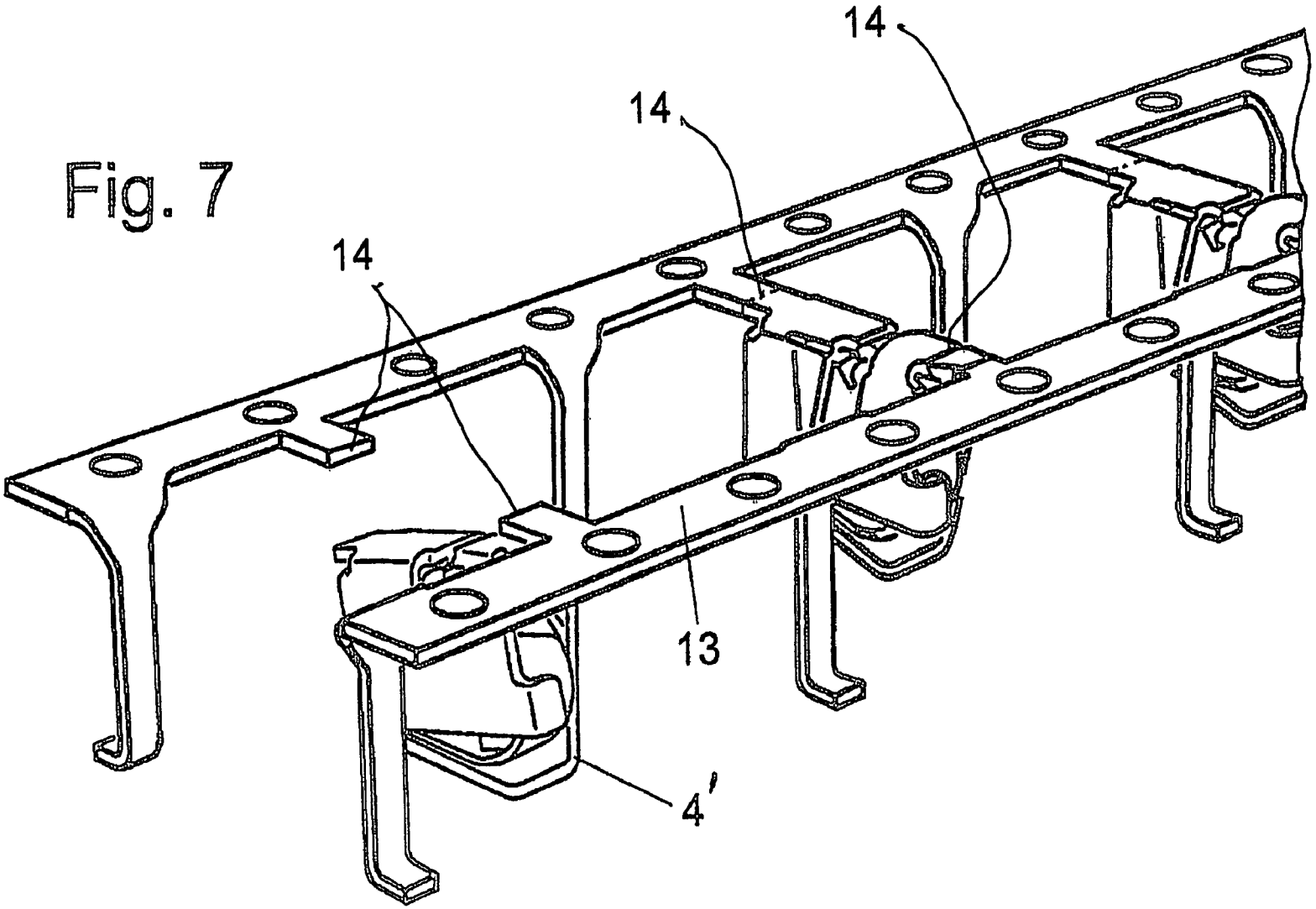

FIG. 5*d* shows how to insert a conductor 2. FIG. 5*c* shows separation from the side essentially normal to the conductor insertion opening using screwdriver 9. As one can see, the spring contact 3, made up of a rectangular sheet metal strip, has two longitudinal legs 3*a* and 3*b*, which are aligned at an acute angle with respect to each other and which are connected with each other by a bending area 3*c*, which here has the shape of an arc. The first longitudinal leg 3*a* of spring terminal 3 is attached to the inside of the first and shorter side wall of the terminal cage 4 and in sectional terms rests directly on the inside of the side wall. Its dimensions correspond to the dimensions of the inside of the side wall. The contact point for the conductor is formed upon a clamping edge 3*d*, which presses the conductor against the inside of terminal body 4.

The mounting surfaces 10 11 on the bottom walls 5*c* and 55*g* are suitable for surface mount device (SMD) assembly on a component, in particular, a printed circuit board. As an alternative, one can also provide soldering legs. The SMD assembly, however, is particularly simple.

Figure 8:
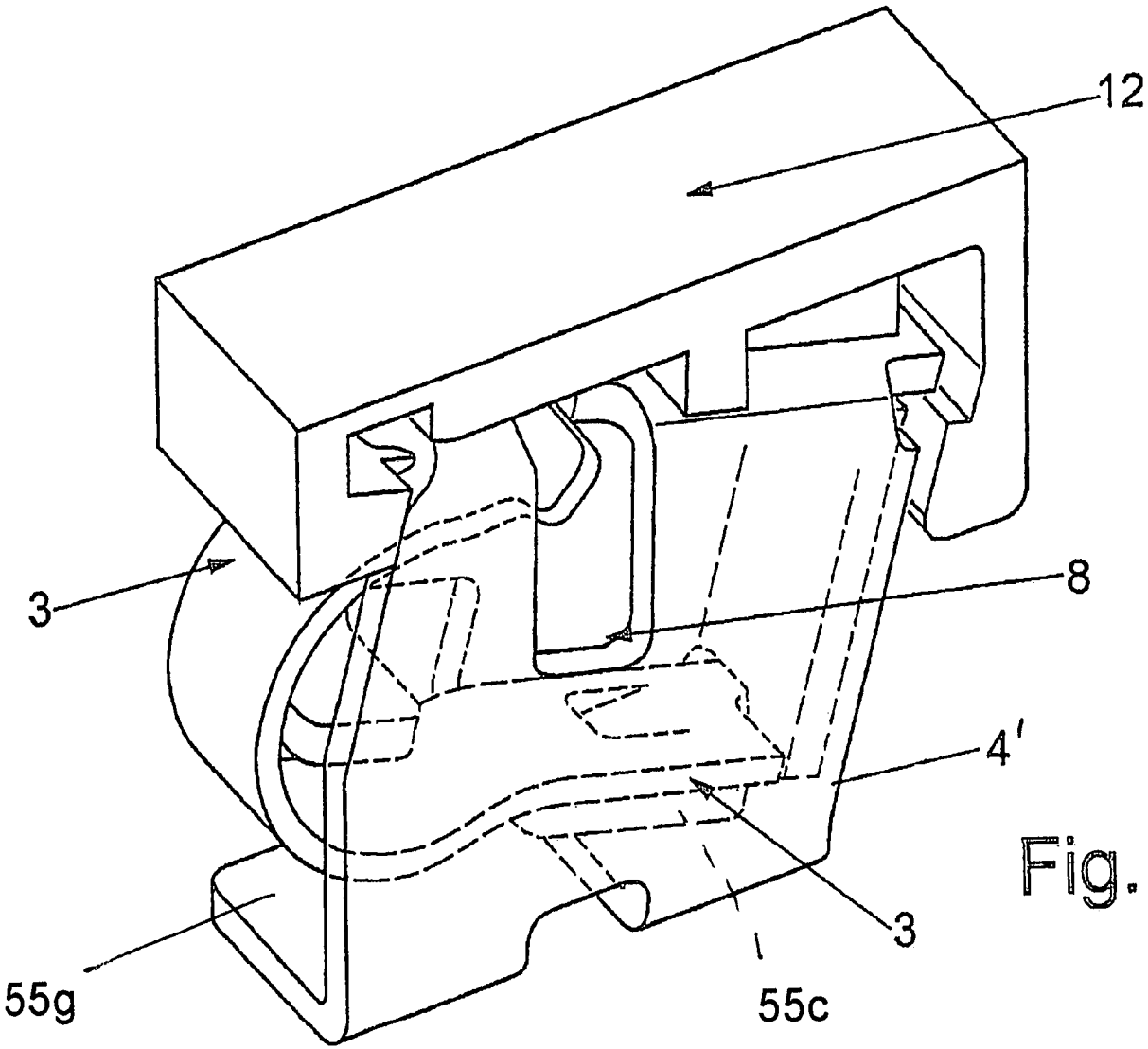
FIG. 8 is a perspective view illustrating the manner of transport of a connector by means of a pick and place pad.

It is also possible to arrange a kind of pick-and-place pad 12 upon the terminal cage 5 for automated assembly (FIG. 8).

The invention-based method is particularly advantageous for the assembly of the connector devices. In this method, the sheet metal blank of which the connection device is made up—or some other part of a connection terminal or device—remains connected with an assembly line 13 via defined and possibly weakened separation points 4, which assembly line is punched out of sheet metal from which is fashioned also the sheet metal blank for the terminal body. Here there are two separation points on both front sides of the terminal cage 4. Assembly line 13 is, so to speak, made in two parts on both sides of the terminal body 4.

Generally speaking, following the preliminary manufacturing step, a part of the connector remains connected with an assembly line. Preferably, a metal sheet metal part of the connection device is connected with a metal strip 13—a carrier band—according to FIG. 13. In order to roll it off in a defined manner, the assembly line can have grid-like perforations 21.

Figure 2B:
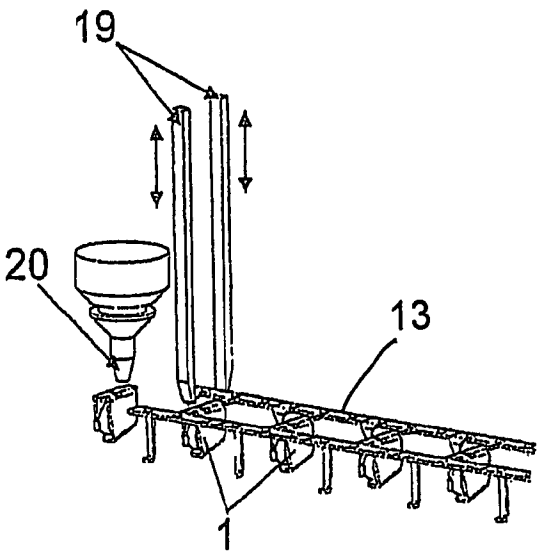
Figure 3E:
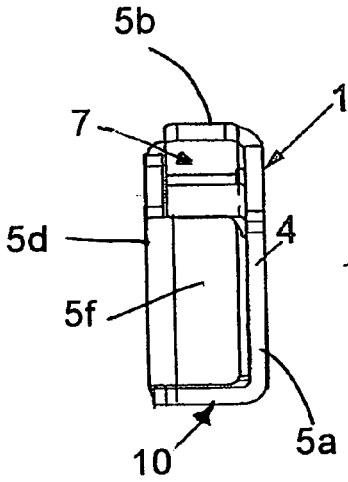
FIGS. 3*a*-3*e* are rear perspective, front perspective, top, front end and left side plan views, respectively, of a first connector embodiment.
Figure 3D:
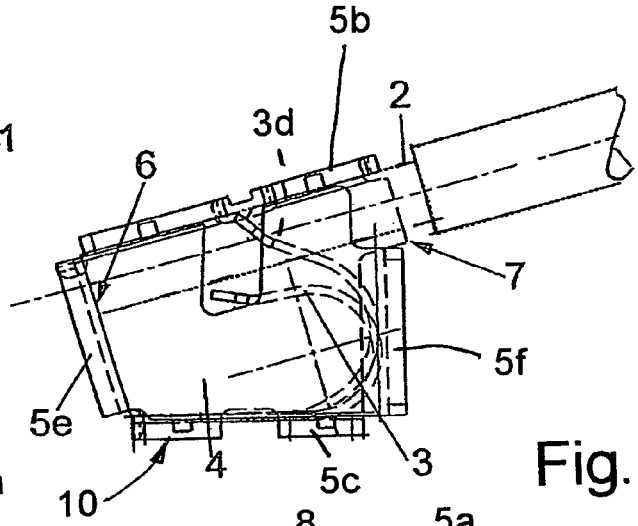
Figure 3C:
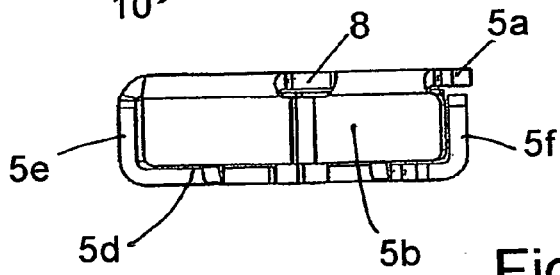
Figure 3A:
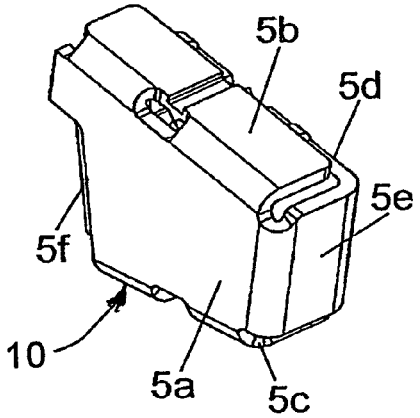
Figure 3B:
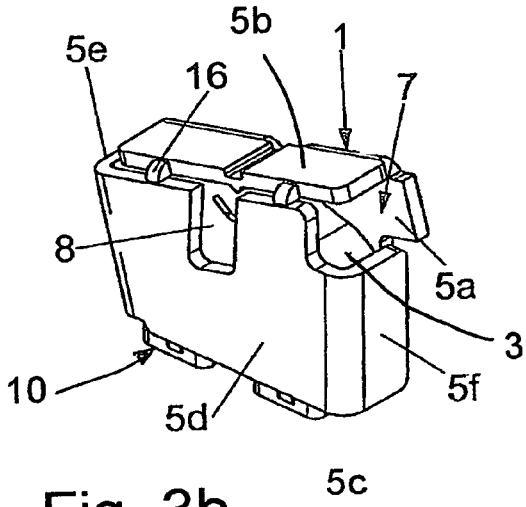

The sheet metal blanks are punched out on the assembly line 13 for assembly purposes. Then on assembly line 13, the sheet metal blanks are folded together to form the terminal body 4, whereby also the spring contact 3 is mounted and possibly fastened provisionally. Terminal body 4 remains on assembly line 13. On remaining narrow points, it is preferably connected with assembly line 13 and, looking at FIG. 1, it is essentially aligned perpendicularly to the actual assembly line 13. Then assembly line 13 is wound up upon a spool 17 or a reel (FIG. 2) from which it can again be unwound during assembly. This spool is transported to the assembly site. The connection devices, arranged one behind the other on assembly line 13, are separated from assembly line 13 by some kind of punch tool or an assembly stamp 15, 19 only at the assembly site as such, preferably during the stocking of a component 18 (FIG. 8), such as a printed circuit board, and they are preferably placed on the components by means of a suction pipette 20, where they can be soldered together, for example, by way of the SMD technique.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector arrangement, comprising:

(a) a generally rectangular hollow connector body (4) formed by stamping and bending from a conductive metal sheet including;

(1) a pair of parallel spaced vertical side walls (5*a*, 5*d*; 55*a*, 55*d*);

(2) a generally horizontal top wall (5*b*, 55*b*) orthogonally arranged relative to said side walls, respectively;

(3) at least one vertical end wall (5*e*, 55*e*) orthogonally arranged relative to said side walls; and (4) a generally horizontal bottom wall (5*c*; 55*c*) cooperating with said side and end walls to define a chamber;

(5) said side walls being integral with and bent from parallel opposite edges of a given one of said end (5*e*) and top (55*b*) walls, respectively;

(b) a generally U-shaped resilient spring contact (3) mounted in said chamber, said spring contact including:

(1) a generally horizontal bottom leg (3*a*; 3*a*') connected with said bottom wall;

(2) a top leg (3*b*, 3*b*') adjacent said top wall; and (3) a connecting portion (3*c*; 3*c*') connected between said bottom and top legs, said top leg being resiliently biased away from said bottom leg, thereby to bias toward said top wall a bare conductor (2) introduced into said chamber via an opening (7) contained at one end of said connector body;

(c) said top wall being connected with one of said side walls by a corner edge portion containing an access opening (8) opposite said spring contact top leg, thereby to permit the insertion into said chamber of the tip of an operating tool (9) to release said top leg from engagement with the conductor, whereby the conductor may be withdrawn from said chamber;

(d) said connector body having at least one generally horizontal bottom connecting surface (10, 11) adapted for connection with an electrical component.

2. An electrical connector as defined in claim 1, wherein said top wall (5*b*) is integral with said side walls; and further wherein said connecting surface is defined by the bottom surface of said bottom wall.

3. An electrical connector as defined in claim 1, and further wherein one of end walls (55*e*) is integral with said connector body side walls; and further wherein one of said side walls (55*d*) includes an orthogonally bent second bottom wall (55*g*) that extends in parallel spaced relation below said body bottom wall, the bottom surface of said second bottom wall defining said connecting surface.

4. An electrical connector as defined in claim 1, and further including a printed circuit board (18) having an electrical circuit connected with said connector housing.

5. An electrical connector as defined in claim 1, and further including weld means (16) securing together at least two of said connector body walls.

6. An electrical connector as defined in claim 1, wherein said top wall includes an upper surface that defines a suction surface for use in the automated assembly of the connector body to an electrical component.

7. An electrical connector as defined in claim 1, wherein said connector body given wall is severed from a sheet of metal material (13) at given break points (14) following the bending of said side walls to parallel spaced positions orthogonally arranged relative to said given wall.

8. An electrical connector as defined in claim 7, wherein said sheet material is dispensed from a coil (17).

9. A method for forming an electrical connector, comprising:

(a) stamping and bending a sheet of metal material (13) to define a plurality of longitudinally spaced openings separated by transversely-extending longitudinally-spaced strips each including a pair of separation points (14) arranged on opposite sides of a given connector body wall (5*e*; 55*b*);

(b) bending from said metal sheet on opposite sides of said given wall a pair of side walls (5*a* 5*d*; 55*a*, 55*d*) toward positions that extend orthogonally in parallel spaced relation from said given wall;

(c) winding the metal sheet on a spool (17) to define a storage coil;

(d) unwinding the metal sheet from said storage coil in the direction of stamping means (19);

(e) simultaneously stamping the metal sheet to separate said given wall from the sheet at said separation points, attaching a spring contact (3) to one of said walls, and bending from the side walls further walls that cooperate with the other walls to define a rectangular connector body (1) containing a hollow chamber in which said spring contact is arranged; and (f) fastening the connector body to an electrical component (18).

* * * * *